United States Patent [19]

Harris et al.

[11] 4,348,922

[45] Sep. 14, 1982

[54] STOP BOX PEAK LIGHT

[76] Inventors: Albert Harris, 19669 Hull St., Detroit, Mich. 48203; George Spector, 3615 Woolworth Bldg., 233 Broadway, New York, N.Y. 10007

[21] Appl. No.: 166,033

[22] Filed: Jul. 7, 1980

[51] Int. Cl.[3] ..... B25B 13/58

[52] U.S. Cl. ..... 81/180 R; 81/90 D

[58] Field of Search ..... 81/3 R, 3.8, 180 R, 81/90 D; 7/138, 176

[56] References Cited

U.S. PATENT DOCUMENTS 2,116,770 5/1938 Scillia ..... 81/90 D X
2,134,081 10/1938 Gaede ..... 81/180 R

FOREIGN PATENT DOCUMENTS 2347158 11/1977 France ..... 81/180 R
2053438 10/1979 United Kingdom ..... 81/180 R
210874 2/1968 U.S.S.R. ..... 7/170

*Primary Examiner*—James G. Smith

[57] ABSTRACT

A key wrench for turning a valve cross head at a bottom of a stop box of water supply service line toward a house, the wrench including a tubular opening therethrough for a line of sight to the crosshead, electric lamps near the wrench jaws so to light up the cross head, and a magnifying unit on the wrench for enlarging the crosshead view.

2 Claims, 4 Drawing Figures

STOP BOX PEAK LIGHT

This invention relates generally to special valve wrenches.

It is well known to those persons acquainted with the particular field, that municiple water supply to a home in a town or city comes from a water main buried under the street, and a main shut off valve to the house is located along a branch line coming from the main to the house, so that such valve is in front of the house and is located about five feet down in the ground at a bottom of a stop box. Sometimes a house starts to flood due to a break along the service line, so that the municiple water department must be called in order to shut off the water supply to the house and stop the flooding. It can be difficult for the service man to get a conventional key wrench properly on the valve located so far away in the darkness of the narrow stop box, so that he may try to use a flashlight to shine down into the hole. However, due to the narrowness and distance the visibility is very poor, so that such task is troublesome in order to accomplish. This situation is accordingly in need of an improvement.

Therefore it is a principal object of the present invention to provide a key wrench that is self illuminating at its working end, and which includes a sight opening therethrough for seeing directly at the crosshead on the valve in order that it can be easily engaged.

Another object is to provide a key wrench that includes magnification means so that the valve view is more enlarged than seen by a naked eye.

Figure 1:
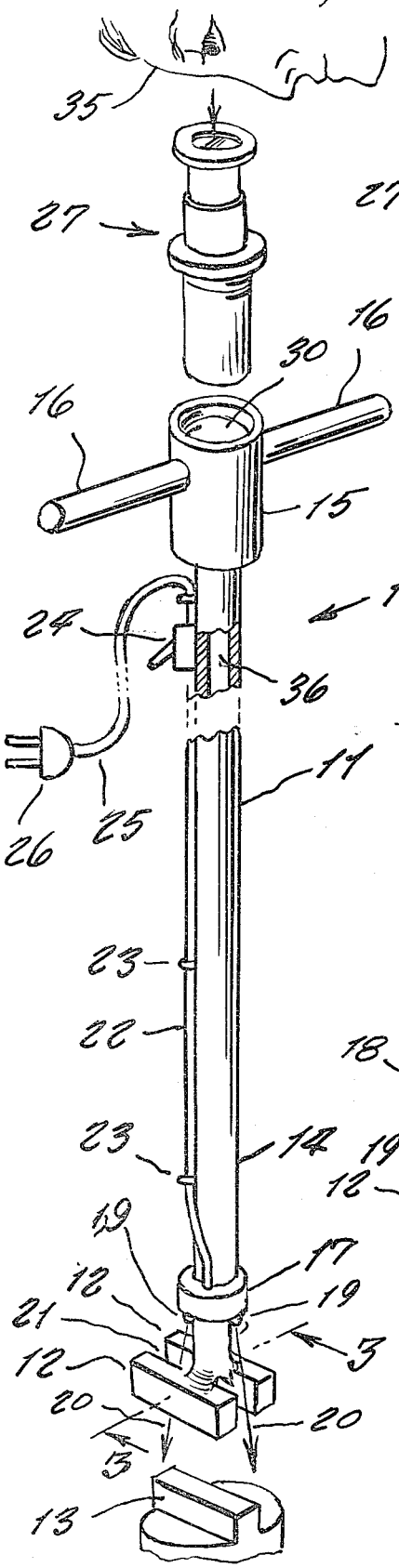
FIG. 1 is a perspective view of one design of the invention in which the illuminating lamps are down near a lower end of the bar, for a stronger illumination at the tee and without glare upwardly to the eye, and viewing downward is through a center of the bar for a view directly at the tee crosshead without any interference from any part of the tool.
Figure 2:
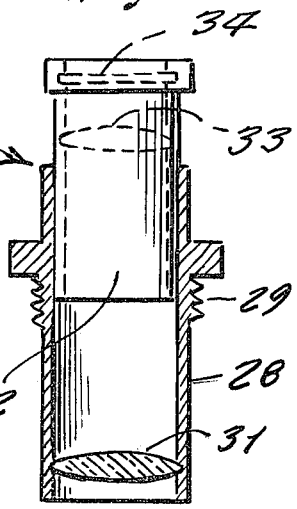
FIG. 2 is a cross section of the telescopic unit.
Figure 3:
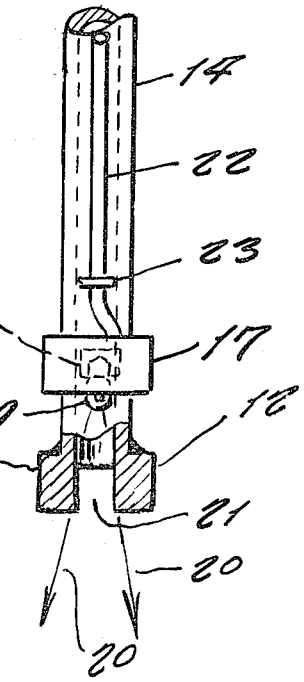
FIG. 3 is a cross section of the lower end of the bar.

Referring now to the drawing in greater detail, and more particularly to FIGS. 1 to 3 thereof, at this time, the reference numeral 10 represents a stop box peak light according to the present invention wherein there is a key wrench 11 having a pair of parallel, spaced apart jaws 12 at its lower end for grasping a cross head 13 of a valve on a tee at a bottom of a conventional stop box. The jaws comprise steel blocks welded across a lower end of a long steel pipe 14 which ats its upper end is welded to a wider diameter sleeve 15.

A sideward cross handle 16 is welded to opposite sides of the sleeve so as to provide leverage for rotating the wrench, thus formed.

In the present invention, a collar 17 welded around the pipe and located a short distance from the jaws, is fitted with electric lamp sockets 18 therein so to hold minature lamp bulbs 19 that shine in a downwardly direction as indicated by arrows 20. The lamp bulbs are located so that the light rays thereof shine downwardly through a space 21 formed between the jaws, so that the light rays shine unobstructedly directly at the top of the valve cross head. An electric cable 22 secured at several plates 23 along an outer side of the pipe, contains a pair of electric conductors which at one end are attached to the two sockets, and which at their other end are connected to a switch 24 located near the upper end of the wrench, for convenient operation. An extension cord 25 extends loosely from the switch and may fit with a plug 26 on its end for connection to a household electric outlet or may have clamps to connect with battery terminals.

A magnifying unit 27, slidable into the upper end of the sleeve, includes an outer tube 28 having screw thread 29 engagable with screw thread 30 of the sleeve. A lens 31 is in a lower end of the tube. An inner tube 32 slidable in the outer tube has a lens 33 therein. A plain, clear glass 34 closes the upper end of the tube 32.

In use, a workman 35 places the wrench into the stop box and looks down through the device so that his line of sight passes through the magnifying unit and through the central hole 36 of the pipe so as to look directly at the valve cross head.

He adjust the tubes 28 and 32 telescopically for a clear focus. He thus sees the illuminated crosshead clearly enlarged, so to easily seat the crosshead in the space 21 between the wrench jaws, and is then ready to turn the wrench.

Figure 4:
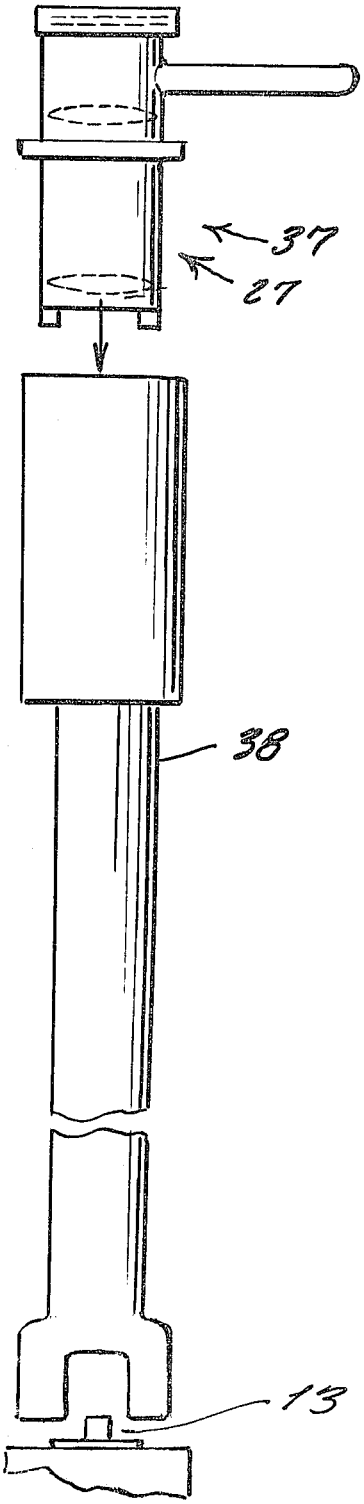
FIG. 4 is a side view of another design of the invention wherein magnification and light is on a top of a stop box.

In a modified design 37 of the invention shown in FIG. 4, the same comprises only the magnifying unit 27 that fits in a top of the stop box 38, the unit being possibly made to include illuminating means.

What is claimed:

1. A key wrench for a stop box, comprising in combination a pipe having spaced apart jaws at its lower end for grasping a crosshead of a valve therebetween, illumination means on said wrench being located near said jaws, a magnifying unit upon an upper end of said wrench, and cross handles near said upper end for turning said wrench, wherein said illumination means comprises lamps aligned with a slot between said jaws.

2. The combination as set forth in claim 1, wherein said magnifying unit comprises a telescope device.

* * * * *